United States Patent [19]

Morel

[11] Patent Number: 5,004,127

[45] Date of Patent: Apr. 2, 1991

[54] CAP WITH A ROTATING CASING FOR FLASKS, TUBES AND SIMILAR CONTAINERS

[76] Inventor: Simone Morel, 11 rue du Faubourg de Paris, 51210 Montmirail, Marne, France

[21] Appl. No.: 350,280

[22] Filed: May 10, 1989

[30] Foreign Application Priority Data

May 11, 1988 [FR] France ..... 88 06381
Mar. 17, 1989 [FR] France ..... 89 03544

[51] Int. Cl.[5] ..... B67D 5/32

[52] U.S. Cl. ..... 222/521; 222/83; 222/91; 222/505; 222/531

[58] Field of Search ..... 222/505, 509, 519–526, 222/531, 532, 537, 548, 549, 555, 83, 91

[56] References Cited

U.S. PATENT DOCUMENTS

| | | | |
|---|---|---|---|
| 2,711,271 | 6/1955 | Schlicksupp | 222/521 X |
| 2,769,582 | 11/1956 | Schlicksupp | 222/521 X |
| 3,372,833 | 3/1968 | Baranne | 222/525 X |
| 4,314,656 | 2/1982 | Kessler | 222/525 X |
| 4,380,310 | 4/1983 | Schneiter et al. | 222/525 X |
| 4,383,623 | 5/1983 | Page, III | 222/525 X |
| 4,469,249 | 9/1984 | Malpas et al. | 222/83 |
| 4,690,304 | 9/1987 | Morel | 222/520 X |
| 4,779,764 | 10/1988 | Debetencourt | 222/521 X |
| 4,805,807 | 2/1989 | Perne et al. | 222/521 X |

FOREIGN PATENT DOCUMENTS

| | | | |
|---|---|---|---|
| 209483 | 7/1940 | Switzerland | 222/524 |

*Primary Examiner*—Kevin P. Shaver
*Attorney, Agent, or Firm*—Browdy And Neimark

[57] ABSTRACT

The cap comprises a casing rotatively mounted on a container with a groove being provided to prevent said casing from axially sliding. The casing is connected slidably to a bell which is itself connected by a helicoidal thread to a sheath mounted on the container. The bell is provided with a neck having a wall bordering an opening for containing a stopper connected to the container.

15 Claims, 5 Drawing Sheets

FIG. 5
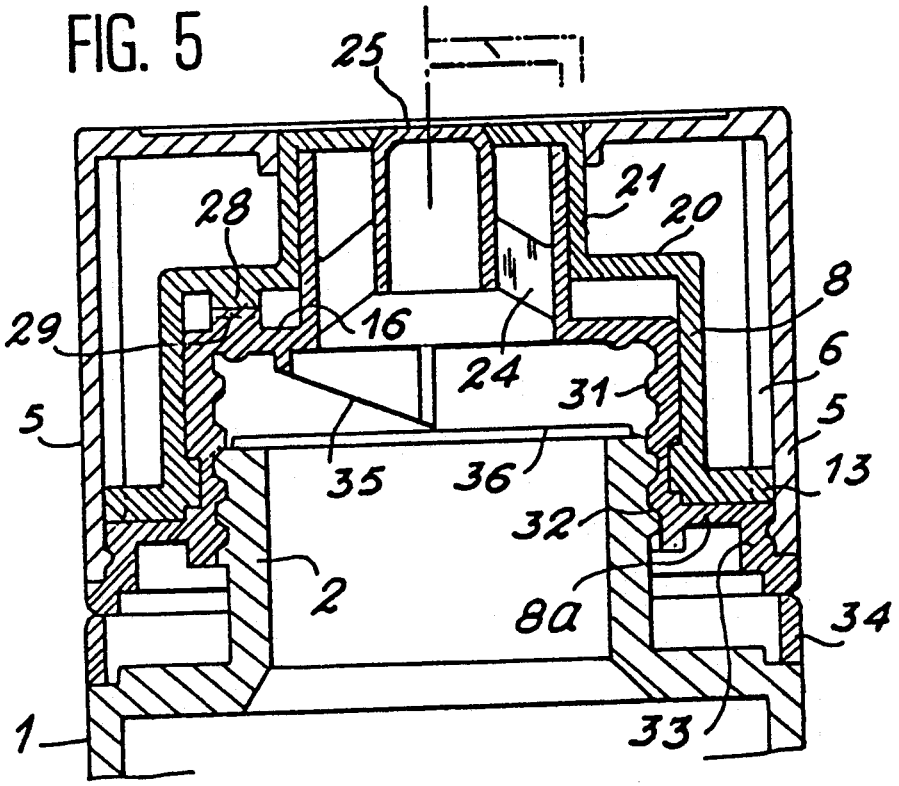
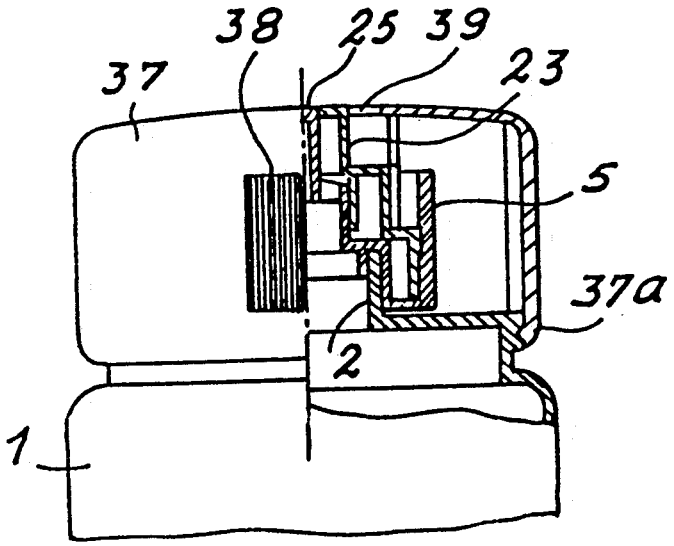
FIG. 6

CAP WITH A ROTATING CASING FOR FLASKS, TUBES AND SIMILAR CONTAINERS

BACKGROUND AND SUMMARY OF THE INVENTION

The present invention concerns caps for the closing of various containers such as flasks and tubes.

In particular, the invention applies to the caps which are permanently mounted on the container so as to allow an opening and closing of the container by simply rotating the external part of the cap.

The cap of the invention has for its purpose to ensure that the cap internally forms a continuous conduit for the flowing of a fluid contained in the container, and this both the cap is applies to both in the closing position and in the opening position, for which opening position it may form a pouring element.

Moreover, the purpose of the invention is to ensure that the conduit delimited inside the cap, and whose length varies between the closing and the opening position, is always fully fluid tight and, in order to achieve this result, the invention starts with the surprising discovery that it is necessary, upon each opening and closing movement of the cap, to wipe dry some parts of the conduit which slide with respect to one other. Therefore the contents of the cap cannot accidentally flow out or be made in contact with the atmosphere.

Moreover, in order to provide a proper wiping dry of the parts of the conduit, it has been observed that it is not sufficient that these parts are displaced axially with respect to one other as this tends to form streaks, whereas a more effective wiping dry is obtained when the parts of the conduit having to be moved with respect to one another follow a helicoidal movement.

The invention further allows for an implementation of various types of stoppers which can ensure a controlled flowing of the product contained in the flask or tube or even a spraying and an atomization of this product, the cap ensuring always a fully effective closing of the flask or tube and, whenever applicable, preventing an activation of a spraying or atomizing stopper.

In accordance with the invention, the cap with a rotating casing for flasks and similar containers is characterized in that the casing is rotatively mounted on the flask, means being provided to prevent the casing from sliding axially, and the casing being connected by sliding means to a bell shaped member, which bell shaped member is itself connected by helicoidal means either to a sheath or to the neck of a flask, this bell shaped member being provided with a neck having a wall bordering an opening so as to contain a fixed stopper connected to the container.

Various further features of the invention will moreover be revealed from the following detailed description.

BRIEF DESCRIPTION OF THE DRAWINGS

By way of examples in no way restrictive, some embodiments of the invention are represented with reference to the accompanying drawings, in which:

FIG. 5 is an elevation cross section of a further variant;

FIG. 6 is an elevation, partly in cross section, showing one additional characteristic;

DESCRIPTION OF THE PREFERRED EMBODIMENTS

Figure 1:
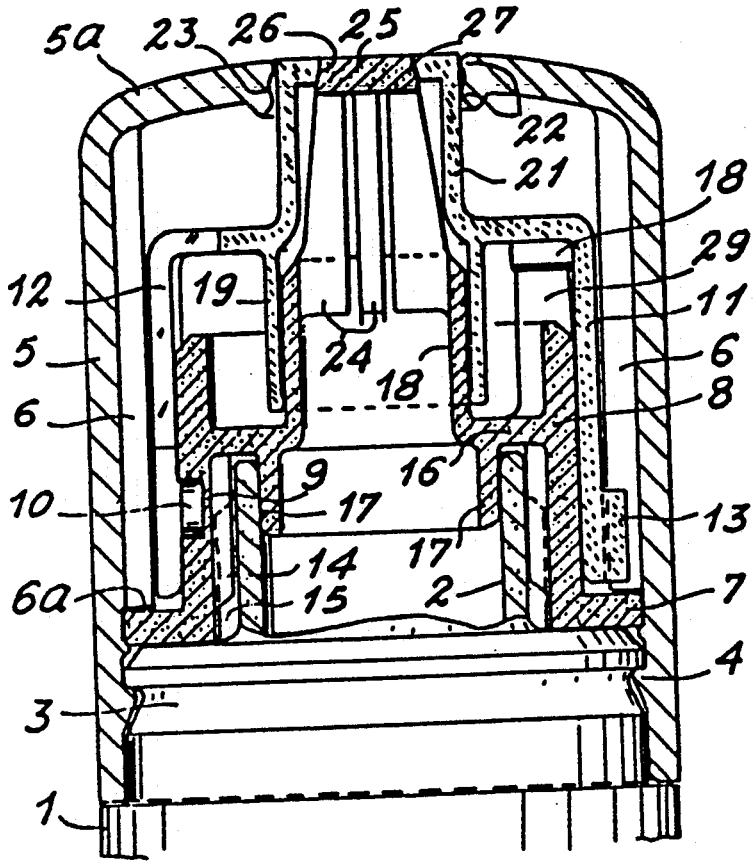
FIG. 1 is an elevation cross section of the rotating casing cap of the invention.

The cap of the invention is intended to be mounted on a flask 1 or other container which comprises a neck 2 having a groove 3 for a retainer ring 4 of a casing 5 thus able to rotate with respect to the flask 1 but without being able to move axially.

The casing 5 is provided with internal axial ribs 6 whose base 6*a* supports a collar 7 formed at a foot of a sheath 8 having a helicoidal rib 9 inside its external wall.

The helicoidal rib 9 serves to house a block 10 formed inside a bell shaped member 11 preferably near a slot 12 of the bell shaped member 11, the lower part of which therefore is flexible. The wall of the bell shaped member 11 has at least one key 13 housed between two ribs 6 of the casing 5, so that the bell shaped member 11 is integrally rotated with the casing 5.

It can be seen from the above disclosure that, by making the casing 5 to rotate, it results in the bell shaped member 11 rotating, and therefore the block 10 will move inside the helicoidal rib 9, which causes a raising or a lowering of the bell shaped member 9 according to the rotation direction of the casing 5.

To prevent rotation of the sheath 8, means are provided which may be constituted by ribs 14 and grooves 15 formed respectively from the internal wall of the sheath 8 and the outer wall of the neck 2.

It is also possible that the sheath 8 is merely forcingly engaged onto the neck 2, or even that the collar 7 is sufficiently tightened onto the neck 2 so that the sheath 8 cannot rotate to any significant extent. Finally, the sheath 8 can be screwed onto the neck 2.

The drawings show that the sheath 8 forms an internal shoulder 16 from which a lower ring 17 and an upper ring 18 are respectively formed. The lower ring 17 is pushed against the internal wall of the neck 2 and consequently ensures a fluid tightness with the neck 2. The upper ring 18 is, for its part, pushed against a skirt 19 formed inside the bell shaped member 11 from the upper part 20 of the bell shaped member 11.

The skirt 19 is extended upwards by a neck 21 which is guided inside a labyrinth gasket 22 formed by bordering an opening 23 formed in this upper part 5*a*.

The upper ring 18 of the sheath 8 is provided with lamellas 24, radial lamellas for example, forming a support for a stopper 25, preferably of a conical shape, intended to cooperate with a complementary wall 26 forming an opening 27 at top of the neck 21.

Figure 2:
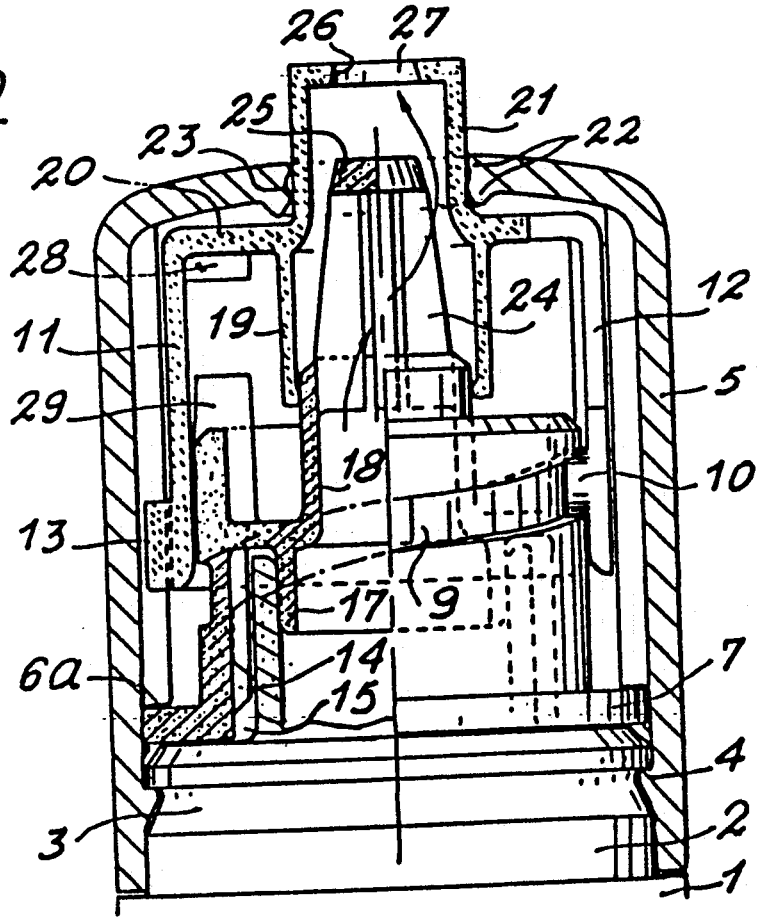
FIG. 2 is a half cross section, partly in elevation corresponding to FIG. 1, but showing a characteristic position of the elements of the cap.

As explained above, when the casing 5 is rotatively driven whilst the various elements previously described are in the position illustrated in FIG. 1, the block 10 is rotated and consequently follows the helicoidal groove 9, which causes the bell shaped member 11 to raise and, consequently, the neck 21 of the bell shaped member 11 will slide between the gaskets 22 which ensures a fluid tightness with its external wall, so that the cap is then in the position illustrated in FIG. 2.

FIG. 2 shows that the stopper 25, which is fixed, is then separated from the wall 26 of the opening 27 so that a continuous passage is created from the inside of the flask 1 to the opening 27.

The drawings also clearly show that the passage formed from the inside of the container is a passage having a fluid tight wall. Actually, the lower ring 17 ensures a fluid tightness with the neck 2, the upper ring 18 ensures a fluid tightness with the skirt 19, and the neck 21 extends to the opening 27.

Thus, the fluid contained within the flask 1 cannot spread inside the cap, which prevents it from being soiled and similarly prevents leaks to occur when the fluid is poured through the opening 27.

To ensure closing, the casing 5 is rotated in a direction opposite to that corresponding to the opening until the moment when the wall 26 of the neck 21 is applied against the stopper 25. During this movement, the skirt 19 slides on the wall of the upper ring 18, so that a fluid tightness is always provided.

To avoid an accidental opening, it is advantageous that a stop 28 is formed from the internal wall of the upper part 20 of the bell shaped member 11 and that a flexible tongue 29 is formed from the sheath 8.

FIG. 1 shows in this respect that in the closing position of the cap, the stop 28 rests against the tongue 29, thus creating a brake preventing opening, since a sufficient effort must be exerted on the casing 5 to cause it to rotate by elastically deforming the tongue 29 at the start of rotation of the casing 5. Although not positively shown, the sheath 8 can obviously be directly formed by an extension of the neck 2 of the flask 1, the skirt 19 of the bell shaped member 11 then taking support on the internal wall of an extension of the neck 2 so as to ensure fluid tightness when the bell shaped member 11 moves.

The embodiment as described above provides for low cost production by means of thermoplastic resin injection molding. Actually, the casing 5, the bell shaped member 11 and the sheath 8, whenever the sheath 8 is separate from the neck 2, constitute three parts which can be easily produced by injection molding technique.

As regards mounting of the cap, this is very simple and can be mechanically embodied. Actually, the sheath 8, whenever there is such a sheath 8, is only engaged on the neck 2, the bell shaped member 11 is itself engaged on the sheath 8, the block 10 being engaged into the helicoidal groove 9 by elastic deformation caused by the presence of the slot 12, and finally the casing 5 is itself engaged onto the bell shaped member 11, the retainer ring 4 being snapped by elastic deformation into the groove 3.

In FIGS. 3-6, the same reference numerals designate the same elements as in FIGS. 1-2.

Figure 3:
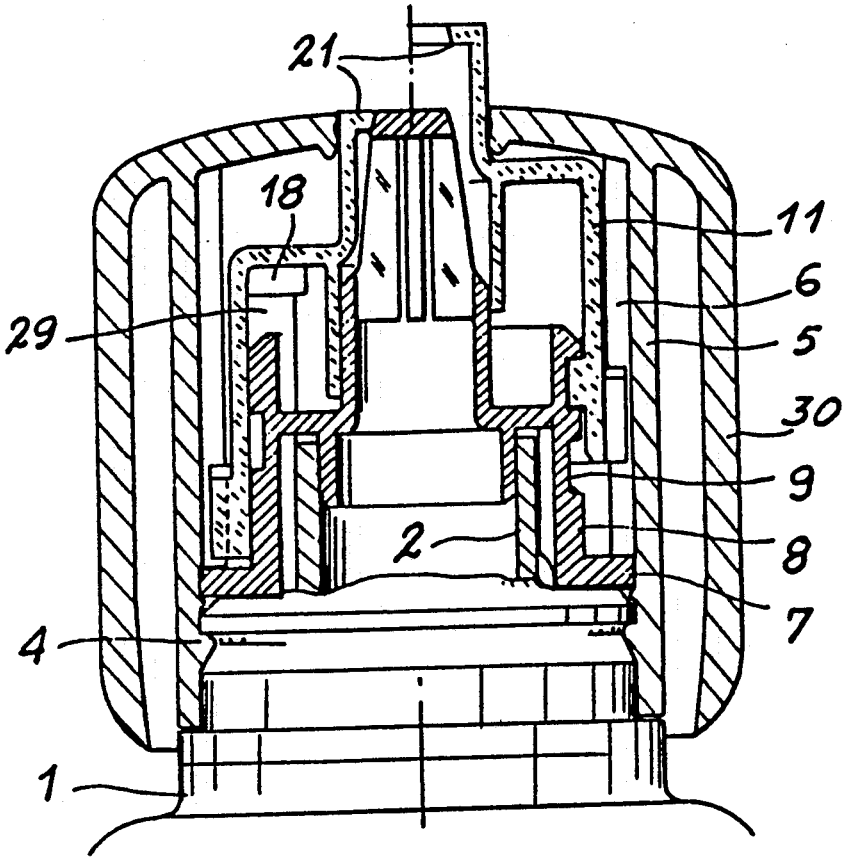
FIG. 3 shows two half cross sections of a variant of the cap.

In FIG. 3, the casing 5 of the cap of the invention is made by a part provided with an external mantle 30 having an external form which advantageously corresponds to that of the flask 1 or other container. The control of the cap is ensured by manually causing a rotation of the mantle 30 whose rotative movement is transmitted to the casing 5 and, by means of the casing 5, to the other elements described above.

Figure 4:
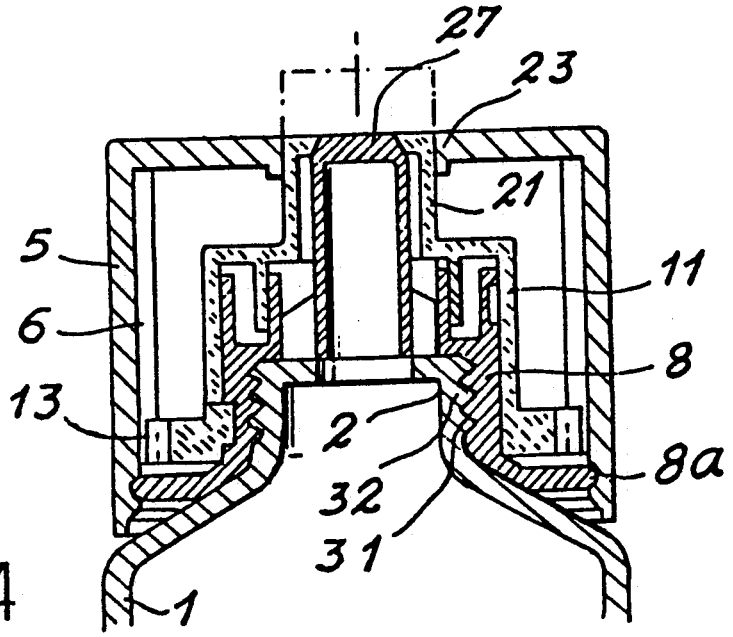
FIG. 4 is an elevation cross section showing another variant of the cap.

In FIG. 4, the casing 5 of the cap of the invention is connected to the neck 2 of the flask 1 by means of a sheath 8 having a base which forms a disk **8*a* on which the casing 5** is snapped.

In this embodiment, the sheath 8 comprises an internal screw thread 31 enabling for the sheath 8 to be screwed onto a corresponding threading 32 of the neck 2. The other parts of the cap are embodied similarly as described in reference with FIGS. 1 and 2. This embodiment provides for the cap to be possibly mounted and dismounted, since it is possible to screw and unscrew the sheath 8.

FIG. 5 illustrates a development of the embodiment of FIG. 4, in which the sheath 8 supports the casing 5 by means of a ring 33 extending the disk **8*a***.

Also and as shown in FIG. 4, the sheath 8 comprises an internal screw thread 31 intended for screwing the sheath 8 onto a threading 32 of the neck 2 of the flask 1.

The ring 33 is extended by a rupture ring 34 forming at the same time an inviolability device and a brace between the cap and the flask 1.

In addition to the above description, the cap of FIG. 5 comprises, underneath the internal shoulder 16 of the sheath 8, a blade-shaped perforating device 35, which is placed over a film 36 sealing the neck of the flask 1.

In order to have access to the product contained in the flask 1, the rupture ring 34 is removed, then the cap is screwed by acting on its casing 5 until the internal shoulder 16 of the sheath 8 comes to rest on the top part of the neck 2. During this movement, the perforating device 35 breaks the film 36. The cap is then ready to be used in the same way as previously described.

FIG. 6 illustrates a developing stage of the invention, wherein the casing 5 of one of the embodiments of the cap of the above-mentioned figures is covered by a cover 37 directly fixed by its base **37*a* to the flask 1, via snapping means for example. The cover 37 comprises at least one aperture 38, preferably two apertures, giving access to the casing 5 whose peripheral surface is advantageously knurled or otherwise rendered rough. The cover 37 forms on its top part a hole 39 for the passage of the neck 21 when the neck 21 is lifted when the casing 38** is moved as previously described.

It should be noted that the top part of the neck 21 can be provided to have several openings such as the opening 27 of the preceding figures each of which openings corresponding to a stopper 25 but, in this case, the various stoppers 25 are made of a flexible material so that they can be elastically deformed during the helicoidal movement causing opening and closing of these stoppers required for each opening 27. The above-mentioned sheath 8 can further be directly formed by the neck 2 of a tube or other bottom-filled container.

In FIGS. 7-10, the casing 5 is provided with internal axial ribs 6 having a base **6*a* resting on a collar 7*a* formed by the neck 2 which forms, above the collar 7*a*, a sheath 8*a* having in its wall a helicoidal groove 9. Therefore, the sheath 8*a* is formed by an extension of the neck 2 of the flask 1**.

The groove 9 houses at least one block 10 formed inside a bell shaped member 11.

Figure 8:
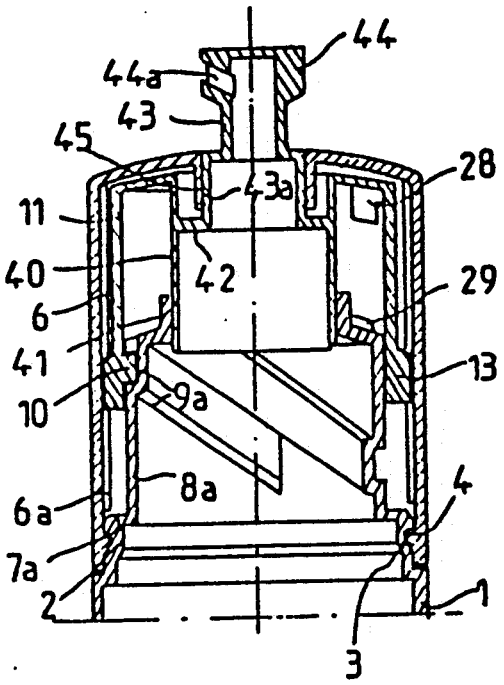
FIG. 8 is a cross section similar to FIG. 7 showing a characteristic position of the cap.
Figure 7:
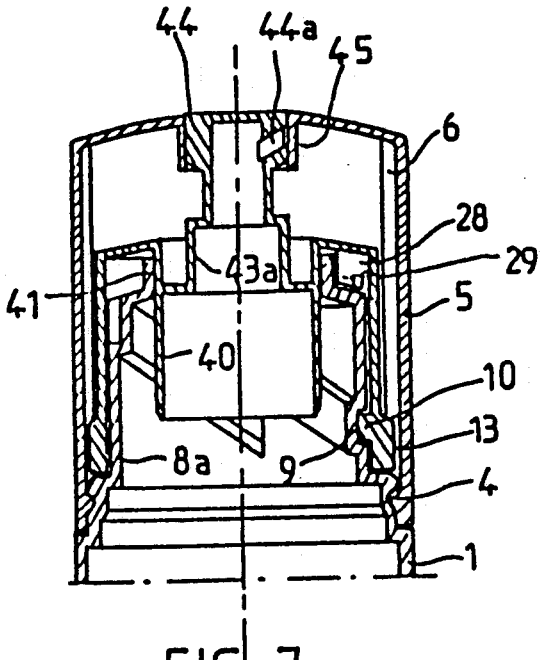
FIG. 7 is an elevation cross section of the cap showing another embodiment.

In the embodiment of FIGS. 7 and 8, the bell shaped member 11 internally forms a skirt 40 which is engaged with a slight friction in a cylindrical contracted part 41 of the sheath **8*a*. Furthermore, the skirt 40 is connected by means of a ring 42 to a stopper forming a spout joining piece 43 with a lateral spout mouth 44 whose opening is shown at 44a**.

The stopper forming the spout joining piece 43 on a part of its height a cylindrical element 43a of slidable inside a sleeve 45 of the casing 5.

As shown in FIG. 7, in the rest position, the block 10 is placed at the base of the helicoidal groove 9 and, consequent)y, the lateral spout mouth 44 of the stopper forming the spout joining piece 43 is placed inside the sleeve 45, thus ensuring closing.

With the skirt 40 being engaged in the cylindrical contracted part 41 of the sheath 8a, this 5 ensures a fluid tightness with the sheath 8a so that the product contained inside the flask 1 can neither leak nor soil the inside of the bell shaped member 11, nor the inside of the casing 5.

By making the casing 5 to rotate with respect to the flask 1, the internal axial ribs 6 of the casing 5 drive at least one key 13 which is outside on the bell shaped member 11 which is thus rotatively driven. This results in the block 11 circulating in the helicoidal groove 9 of the sheath 8a by causing the axial movement of the bell as far as the position shown in FIG. 8 is obtained. The stopper forming the lateral spout mouth 44 is then in the operative position, and so that the product contained inside the flask 1 can flow.

It is advantageous that the bell shaped member 11 is internally provided with a flexible stop 28 and that the sheath 8a comprises a tongue 29, the stop 28 and the tongue 29 cooperating together in the closing position as illustrated in FIG. 7, thus avoiding an ill-timed functioning of the cap by the locking so made.

In the above-mentioned description, the sheath 8a is shown as being formed by an extension of the neck 2. It is however possible to bring the sheath 8a onto the upper part of the neck 2, to make the sheath 8a in the form of an independent part and as in the embodiment of FIGS. 1–6.

Figure 9:
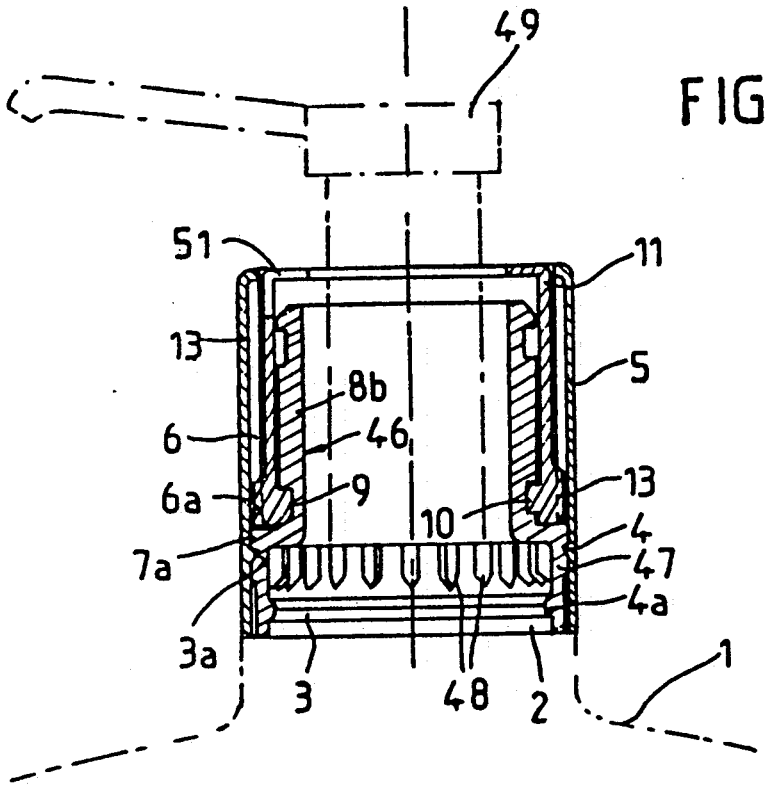
FIG. 9 is a cross section similar to FIG. 7 of a modification.
Figure 10:
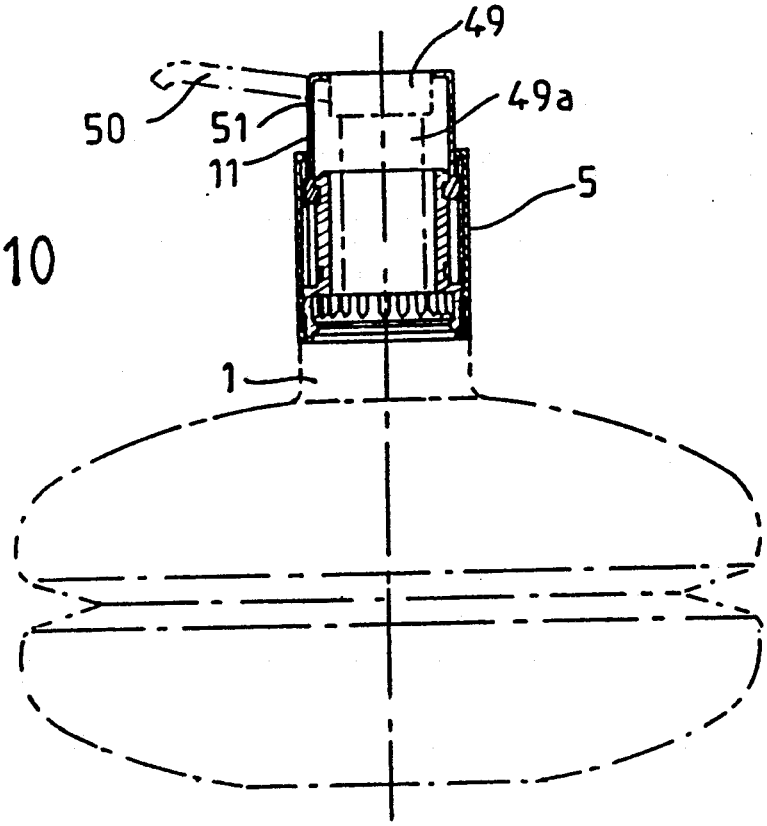
FIG. 10 is a cross section similar to FIG. 9 showing one characteristic position.

According to the modification of FIGS. 9 and 10, a sheath 8b has a smooth internal wall 46, the helicoidal groove 9 being formed in the thickness of the sheath 8b.

At its base, the sheath 8b forms a sleeve 47 having an internal wall which forms a retainer ring 4a entering the groove 3 of the neck 2. Moreover, the sleeve 47 forms ribs and grooves 48 cooperating with the corresponding ribs and grooves of the neck 2 so that the sheath 8b is rigidly connected to the neck 2 without being able to either rotate or slide axially The sleeve 47 has also a groove 3a for the retainer ring 4 of the casing 5.

It is also obviously possible to make the sheath 8b from the neck 2 in a same manner as that illustrated in FIGS. 7 and 8.

Also, in FIGS. 9 and 10 and as represented in FIGS. 7 and 8, the sheath 8b is surrounded by a bell shaped member 11 whose upward and downward movements are provided in the same manner as described above with reference to FIGS. 7 and 8. Thus the bell shaped member 11 is rotatively driven when the casing 5 is itself rotated, the rotative movement being transmitted to the bell shaped member 11 by the key or keys 13 engaged with the internal axial ribs 6.

In the illustrated embodiment, the bell shaped member 11 is open at its top to give access to a stopper constituted by the head 49 of a pump or a valve fixed inside the neck 2 of the flask 1 by any means known in the art so as to allow for spraying or atomization of a liquid product contained inside the flask which possibly contains a propulsive gas when the head 49 is intended to activate a valve.

As shown in FIG. 10, when the head 49 forming the stopper is fitted with a nozzle 50, a notch 51 may be provided in the lateral wall of the bell shaped member 11.

As illustrated in the drawing, when the pump or valve controlled by the head 49 is not to be activated, the casing 5 is rotated so that the bell shaped member 11 is found in the upper position (FIG. 10) and it is not possible to significantly move the head 49. On the contrary, when the pump or valve has to be activated by the head 49, the casing 5 is firstly made to rotate so as to lower the bell shaped member 11 until the position shown in FIG. 9 is reached.

Figure 12:
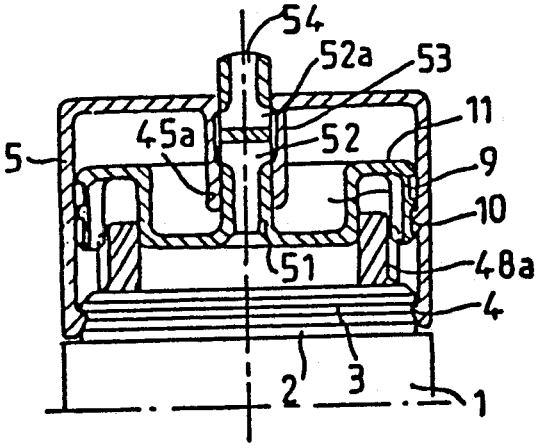
FIG. 12 is a cross section similar to FIG. 11 showing one characteristic position.
Figure 11:
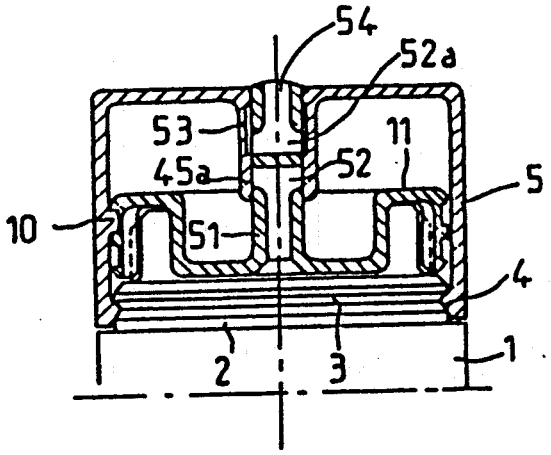
FIG. 11 is a cross section of a variant of embodiment.

FIGS. 11 and 12 illustrate a simplified embodiment in which the casing 5 directly forms the block(s), 10 whereas the helicoidal groove 9 is formed by the bell shaped member 11 which internally has notches and grooves 48 in contact with notches and grooves 48a of the neck 2.

In the embodiment of FIGS. 11 and 12 by making the casing 5 to rotate, this causes a lifting and a lowering, respectively, of the casing 11 which is axially guided by the notches and grooves 48, 48a.

The bell shaped member 11 can be made in accordance with one of the embodiments previously described, or it may comprise a stopper constituted by a hollow core 51 with a lateral aperture 52 able to be sealed off by the base of sleeve 45a formed by the casing 5, which sleeve 45a has a in its wall a recess 53 opposite which can be brought shown in FIG. 12.

The above description shows that in the position illustrated in FIG. 11, the base of the sleeve 45a seals off the aperture 52 of the stopper, which avoids any flow of the product contained in the flask 1, whereas in the position shown in FIG. 12 a flow of the product is possible, the product passing through the aperture 52, the recess 53 and the aperture 52a in order to escape through the opening 54.

The invention is not limited to the embodiments shown and described in detail, since various modifications thereof may be carried out thereto without departing from the scope of the invention. In particular, the hollow core 51 can comprise, as shown in FIGS. 7–8, a lateral flow by-channel instead of the opening 54.

What is claimed is:

1. A cap for a neck of a container, said cap comprising a casing having a dispensing aperture, means for rotatably mounting said casing to said neck and for preventing axially longitudinal movement of said casing relative to said neck, a bell shaped member between said casing and said neck, said bell shaped member having an open position and a closed position, means of said bell shaped member and said casing for slidably connecting said bell shaped member to said casing, a sheath connected to said neck at one end and terminated by a stopper at the other end, helicoidal guiding means of said bell shaped member and said sheath for connecting said bell shaped member to said sheath, said bell shaped member having a neck part slidably disposed within said aperture upon rotation of said casing, and said neck part having an opening which is closed by said stopper when said bell is in said closed position.

2. A cap according to claim 1, wherein the bell shaped member further includes a tubular skirt below said neck part in slidable contact with a conduit of said sheath during movement of the bell shaped member caused by rotation of the casing.

3. A cap according to claim 2, wherein the sheath includes a lower ring engaged within the neck of the container and an upper ring and said upper ring being said conduit in sliding contact with the skirt of the bell shaped member.

4. A cap according to claim 3, wherein the stopper is carried by lamellas extending from the upper ring of the sheath.

5. A cap according to claim 1, wherein the helicoidal guiding means (10) shaped member comprises at least one block formed by the bell shaped member and engaged in a helicoidal groove of said sheath.

6. A cap according to claim 5, wherein the sheath is fixed with respect to the neck.

7. A cap according to claim 1, wherein the sheath comprises a collar connected to the container neck by means of ribs formed inside the casing.

8. A cap according to claim 1, wherein the sheath is non-rotatably connected to the container by means of ribs and grooves.

9. A cap according to claim 1, wherein the bell shaped member is laterally provided with at least one slot.

10. A cap according to claim 1, wherein at least one locking stop is formed inside the bell shaped member so as to cooperate with a flexible lamella of the sheath for rotatively blocked the casing when said casing is rotated to said closed position of the bell shaped member.

11. A cap according to claim 1, wherein the neck of the bell shaped member is slidably sealed in said aperture of the casing by seal formations of said casing.

12. A cap according to claim 1, wherein the casing has a shape corresponding to the shape of the container.

13. A cap according to claim 1, wherein said means for rotatably mounting the casing comprises a disk of the sheath, said sheath having an internal thread screwed onto a threads of the container.

14. A cap according to claim 13, wherein the disk (8*a*) of the sheath is extended by a ring over which the casing is rotatively mounted, said ring being extended by a rupture ring forming a brace between the cap and the container.

15. A cap according to claim 14, wherein a perforating element is provided on the sheath said perforating element extending over a closing film of the neck of the container as long as the rupture ring is not removed and as long as the sheath is not thoroughly screwed on the threads of said container.

* * * * *